United States Patent [19]

Nakazawa et al.

[11] Patent Number: 4,902,206

[45] Date of Patent: Feb. 20, 1990

[54] BELLOWS PUMP

[75] Inventors: Takao Nakazawa, Suginami; Jisaburo Naito, Shinjuku; Hiroyuki Horiki, Chiba; Tutomu Kawashima, Koto, all of Japan

[73] Assignees: Haluna Kabushiki Kaisha; Nisso Engineering Kabushiki Kaisha, both of Tokyo, Japan

[21] Appl. No.: 251,462

[22] Filed: Sep. 30, 1988

[51] Int. Cl.[4] ..... F04B 23/06; F04B 45/02

[52] U.S. Cl. ..... 417/394; 417/473; 417/539; 92/37

[58] Field of Search ..... 417/62, 294, 394, 473, 417/539; 92/37

[56] References Cited

U.S. PATENT DOCUMENTS

| | | | |
|---|---|---|---|
| 2,613,607 | 10/1952 | Sheen et al. | 417/473 X |
| 2,951,450 | 9/1960 | Fisher | 417/473 X |
| 3,751,988 | 8/1973 | Reese, Sr. | 92/37 |
| 4,090,818 | 5/1978 | Hope et al. | 417/473 |
| 4,488,592 | 12/1984 | Mittal et al. | 92/37 X |
| 4,832,580 | 5/1989 | Tsuyoshi et al. | 417/473 X |
| 4,836,756 | 6/1989 | Fukumoto | 417/473 X |

FOREIGN PATENT DOCUMENTS

| | | |
|---|---|---|
| 58-170866 | 10/1983 | Japan . |
| 60-206987 | 10/1985 | Japan . |
| 62-59781 | 4/1987 | Japan . |

*Primary Examiner*—Donald E. Stout
*Assistant Examiner*—Eugene L. Szczecina, Jr.
*Attorney, Agent, or Firm*—Oblon, Spivak, McClelland, Maier & Neustadt

[57] ABSTRACT

A bellows pump which is disclosed herein has two bellows made of a plastic material and provided with liquid inlet and outlet ports for transferring a liquid by expanding and contracting the bellows. The bellows pump comprises cylinder cases in each of which the bellows is vertically expandably and contractably contained and mounted at its access port side to a ceiling of said cylinder cases, gas pumping means for alternately feeding a compressed gas from a lower end thereof into the cylinder cases, a pair of rods passed through bottoms of the cylinder cases and fixed to the lower ends of the bellows, and adapted to be moved in response to the expansion and contraction of the bellows, and actuating means adapted to be operated in response to the up and down movement of the rods.

5 Claims, 3 Drawing Sheets

BELLOWS PUMP

BACKGROUND OF THE INVENTION

1. Field of the Invention

The present invention relates to a bellows pump which is a liquid transfer pump used particularly in industries of medicine, semiconductor, biotechnology, etc., and suitable for transferring high pure liquids.

2. Discussion of Background

Among the reciprocating pumps, the bellows pumps of such a type are employed in wider applications, because a relatively stable performance is assured with a light and simple construction. Particularly, a bellows which has a liquid-contact portion can be made from a heat- and corrosion-resistant plastics and hence, is most suitable even for transferring not only high purity liquid but also various corrosive liquids such as strong acids and strong alkalis.

FIG. 3 illustrates one example of such prior art bellows pumps.

The bellows pump shown in FIG. 3 comprises cylinder cases 2 and 3 horizontally placed within a housing 1 at a predetermined distace spaced apart from each other, bellows 4 and 5 made of a plastic material and contained within the cylinder cases 2 and 3 for lateral expansion and contraction, a rod 6 connected at its opposite ends to opposed end faces of the bellows 4 and 5, respectively, and gas pumping means 7 comprising a compressor and a solenoid valve for feeding a compressed gas alternately into the cylinder cases 2 and 3.

The bellows pump repeatingly produces the drawing and discharging of a liquid through access ports 8 and 9 provided in the bellows 4 and 5 by the bellows 4 and 5 alternately expanded and contracted by the action of the compressed gas fed through the gas pumping means 7. The provision of a check valve leading to the inlet and outlet ports 8 and 9 allows the liquid to be drawn and discharged in a given direction.

Now, in such prior art bellow pump, with a liquid having a higher temperature and a larger specific gravity, the bellows 4 and 5 are deformed due to the temperature and weight of the liquid during repeated use and as a result, a normal operation cannot be maintained. In addition, when the deformation of the bellows 4 and 5 is severe, the bellows 4 and 5 may sag into contact with inner wall of the cylinder cases 2 and 3 and to produce a rubbing.

Further, the prior art bellows pump is accompanied by the problem that because the bellows 4 and 5 are adapted to be laterally expanded and contracted, a gas is liable to be accumulated in the bellows 4 and 5, resulting in an unstable drawing and discharging forces and also in a degraded fixed delivery.

For an approach thereto, it is considered to provide a vertical bellows pump, but only the construction of the prior art bellows pump into a verical type cannot bring a basical solution to the problems, because the accumulation of the gas is produced in the lower one of the upper and lower bellows.

SUMMARY OF THE INVENTION

It is a first object of the present invention to provide a bellows pump having an excellent durability such that bellows cannot be deformed even when a liquid having a high temperature and a large specific gravity is transferred.

It is a second object of the invention to provide a bellows pump having an excellent smooth transferrability and an excellent fixed delivery, in which the accumulation of a gas cannot be produced.

According to the present invention, the above objects are accomplished by providing a bellows pump having two bellows made of a plastic material and provided with liquid inlet and outlet ports for transferring a liquid by expanding and contracting the bellows, comprising cylinder cases in each of which the bellows is vertically expandably and contractably contained and mounted at its access port side to a ceiling of the cylinder cases, gas pumping means for alternately feeding a compressed gas from a lower end thereof into the cylinder cases, a pair of rods passed through bottoms of the cylinder cases and fixed to the lower ends of the bellows, and adapted to be moved in response to the expansion and contraction of the bellows, and actuating means adapted to be operated in response to the up and down movement of the rods.

With the above construction, the load of the liquid acts in a vertical direction of the bellows and therefore, even with a liquid having a high temperature and a large specific gravity, the deformation of the bellows can be minimized to improve the durability.

In addition, the actuating means operated in response to the up and down movement of the rods ensures that the amount of the compressed gas fed into the cylinder cases corresponds to liquid drawing and discharging forces provided by the expansion and contraction of the bellows to enable the fixed delivery of the liquid.

The fixed delivery is further improved from the fact that the accumulation of the gas cannot be produced within the bellows, because the bellows are contained within the cylinder cases and vertically expanded and contracted, and the egress and ingress of the liquid are effected from the upper side of each of the bellows.

The above and other objects, features and advantages of the invention will become apparent from reading of the following description of the preferred embodiments, taken in conjunction with the accompanying drawings.

DESCRIPTION OF THE PREFERRED EMBODIMENTS

Figure 1:
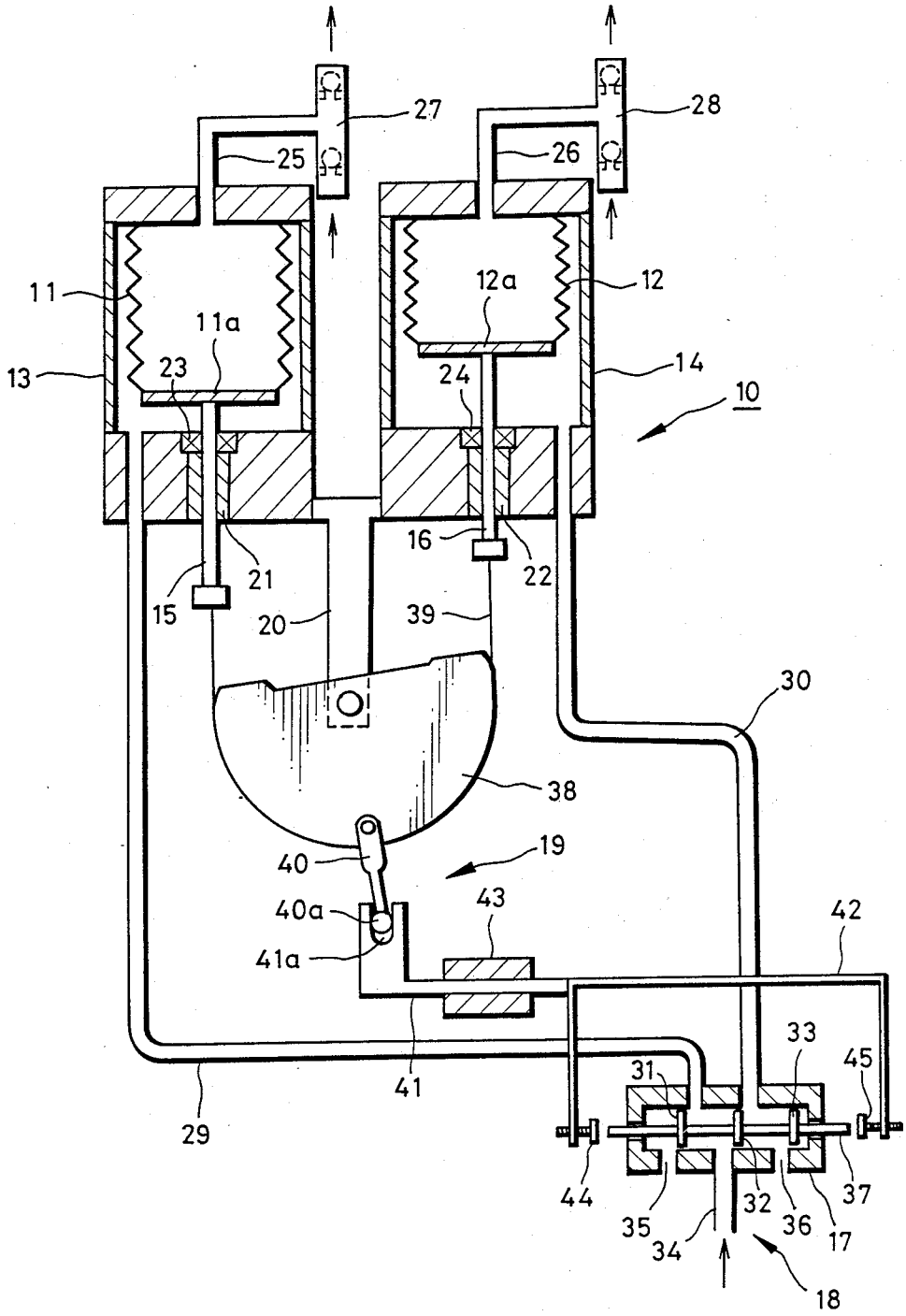
FIG. 1 is a sectional view of the detail of the bellows pump according to a first embodiment of the present invention.

Referring first to FIG. 1, there is shown a bellows pump which is generally indicated by the numeral 10. The bellows pump 10 comprises cylinder cases 13 and 14 having bellows 11 and 12 longitudinally contained therein respectively, rods 15 and 16 passed through bottoms of the cylinder cases 13 and 14 and fixed to lower ends of the bellows 11 and 12, respectively, gas pumping means 18 for alternately feeding a compressed gas into the cylinder cases 13 and 14 through a directional control valve mechanism 17, and actuating means 19 operated in response to the up and down movements of the rods 15 and 16.

Each of the bellows 11 and 12 is made of a heat- and corrosion-resistant plastic material (e.g., a fluorocarbon resin) and has a predetermined internal volume. An upper end of each of the bellows 11 and 12 is opened, with an opened periphery being sealably secured to an inner surface of a ceiling of the corresponding cylinder cases 13 and 14. Plates 11*a* and 12*a* are sealably mounted on lower ends of the corresponding bellows 11 and 12, respectively. Leading ends of the rods 15 and 16 are fixed centrally to lower surfaces of the corresponding plates 11*a* and 12*a*.

The cylinder cases 13 and 14 are contained in a housing (not shown) and vertically juxtaposed, and a stay 20 is fixed between lower side portions of the cylinder cases 13 and 14. Bearings 21 and 22 are mounted at the bottoms of the cylinder cases 13 and 14 for guiding the rods 15 and 16 outside the cylinder cases respectively, and sealing members 23 and 24 are mounted on sides of the bearings 21 and 22 closer to the interior of the cylinder cases 13 and 14, respectively. The rods 15 and 16 have lower ends protruding outside through the sealing members 23 and 24 and the bearings 21 and 22, respectively. The ceilings of the cylinder cases 13 and 14 are provided with access ports 25 and 26 leading to the interiors of the bellows 11 and 12, respectively. The access port 25 and 26 include check valves 27 and 28 which comprise suction and discharge valve balls and permit liquid to be transferred in a given direction in accordance with the expansion and contraction of the bellows 11 and 12.

The gas pumping means 18 comprises the directional control valve mechanism 17 into which is passed a compressed gas from a compressor which is not shown, pipes 29 and 30 permitting the independent communication between the directional control valve mechanism 17 and the interiors of the cylinder cases 13 and 14, and three valve disks 31, 32 and 33 arranged to permit the compressed gas to be fed alternately into the pipes 29 and 30.

The pipes 29 and 30 are connected at their ends to an upper side of a casing body of the directional valve mechanism 17, and the casing body is provided centrally at a lower side with a gas inlet port 34 and with gas outlet ports 35 and 36 located at opposite sides of the gas inlet port 34. The position of the gas inlet port 34 is just below the middle portion between the connections with the pipes 29 and 30, while the positions of the gas outlet ports 35 and 36 are on oppositely outer sides from such connections. The valve disks 31, 32 and 33 are each formed into a size to come into close contact with an inner surface of the casing body and are coaxially attached to a shaft 37 at predetermined distance spaced apart from one another. The shaft 37 is transversely suspended slidably on the opposite side walls of the casing body and protrudes at its opposite ends outside the casing body.

The directional control valve mechanism 17 is designed so that upon rightward movement of the shaft 37 as viewed in FIG. 1, the valve disks 31, 32 and 33 are also moved within the casing body together with the shaft 37, thereby permitting simultaneously the fluid communications between the gas inlet port 34 and the pipe 29 and between the gas outlet port 36 and the pipe 30, as shown in FIG. 1. On the other hand, upon leftward movement of the shaft 37, the valve disks 31, 32 and 33 are also moved within the casing body together with the shaft 37, thereby permitting the fluid communications between the gas inlet port 34 and the pipe 30 and between the gas outlet port 35 and the pipe 29. Extended ends of the pipes 29 and 30 are sealably passed through the bottoms of the cylinder cases 13 and 14 into the latter, respectively.

Therefore, in the gas pumping means 18, the directional control valve mechanism 17 permits the compressed gas to be fed alternately into the pipes 29 and 30, while at the same time permitting the compressed gas within the cylinder cases 13 and 14 to be alternately discharged through the pipes 30 and 29.

The actuating means 19 comprises a segment drum 38 and a belt 39. The drum 38 is pivotally mounted on the stay 20 fixed between the respective lower side portions of the cylinder cases 13 and 14. The belt 39, which may be a flat belt made of a stainless steel, is passed around the drum 38 and fixed at its opposite ends to the lower ends of the rods 15 and 16, respectively.

With such arrangement, when one of the rods 15 and 16 is moved up, the belt 39 travels, thereby rotating the drum 38 to be rotated and moving the other rod down. More specifically, when the compressed gas is fed into one of the cylinder cases 13 and 14 to contract the associated bellows, the drum 38 and belt 39 cause the bellows within the other cylinder case to be expanded in an interlocking manner.

In this case, the up and down movements of the rods 15 and 16 are reversely changed over by the drum 38 and the belt 39 and therefore, the efficiency of transmission of a force is improved and there is no galling between the members.

It should be noted that the drum 38 may be replaced by a circular drum or a gear and further, may be any one having concentric circles at its opposite ends.

The belt 39 may be any one adapted to connect the rods 15 and 16 to each other through the drum 38. Two belts 39 may be used. In this case, the lower end of the rod 15 is connected with one side of the drum 38, and the lower end of the rod 16 is connected with the other side of the drum 38.

The actuating means 19 in accordance with the present invention comprises an arm 40 mounted just below a pivotal center of the drum 38 to depend therefrom substantially perpendicularly, a slider 41 fitted at one end thereof with the lower end of the slider 41 and adapted to be moved horizontally by the pivotal movement of the drum 38, and a change-over lever 42 connected to the other end of the slider 41 for selectively urging one of the opposite ends of the shaft 37 depending upon the direction of movement of the slider 41.

The slider 41 is of an L-shaped section. A vertical portion of the L-shape is formed at its end with a U-shaped portion 41*a*, with which a roller 40*a* mounted on the lower end of the arm 40 is tightly fitted. A horizontal portion of the L-shape is movably held through a bearing 43 and connected at its end to the change-over lever 42. The lever 42 is ⊐-shaped and has the directional control valve mechanism 17 clamped into a ⊐-shaped opening from the above. Urging members 44 and 45 are perpendicularly mounted on the opposite ends of the ⊐-shape, respectively, and the shaft 37 is positioned coaxially with the urging members 44 and 45. In addition, the urging members 44 and 45 have their heads each disposed at a predetermined distance apart from the corresponding one of the opposite ends of the shaft 37 and adapted to urge either one of the ends of the shaft 37 depending upon the direction of movement of the slider 41. The directional control valve mechanism 17 is operable to select the pipe 29 or 30 put in communication with the gas inlet port 34 and the pipe 29 or 30 put in communication with the gas outlet port 35, 36, as described above, depending upon the direction of shaft 37 urged.

Therefore, the actuating means 19 actuates the valve disks 31, 32 and 33 of the directional control valve mechanism 17 by utilizing the movement of the rods 15 and 16 connected by the drum 38 and the belt 39 and hence, it is possible to ensure that the amount of the compressed gas fed into the cylinder cases 13 and 14 corresponds to liquid suction and discharge forces provided by the expansion and contraction, thereby transferring the liquid in a fixed amount.

This fixed delivery is further improved from the fact that accumulation of the gas cannot be produced within the bellows 11 and 12 because they are located inside the cylinder cases 13 and 14 and vertically expanded and contracted, and the suction and discharge of the liquid are effected from the upper side of the bellows 11 and 12 as well as from the fact that it is difficult for the deformation of the bellows 11 and 12 due to the load of the liquid to occur.

Thus, the bellows pump according to the present invention has a significant effect with a liquid having a higher temperature and a larger specific gravity.

Figure 2:
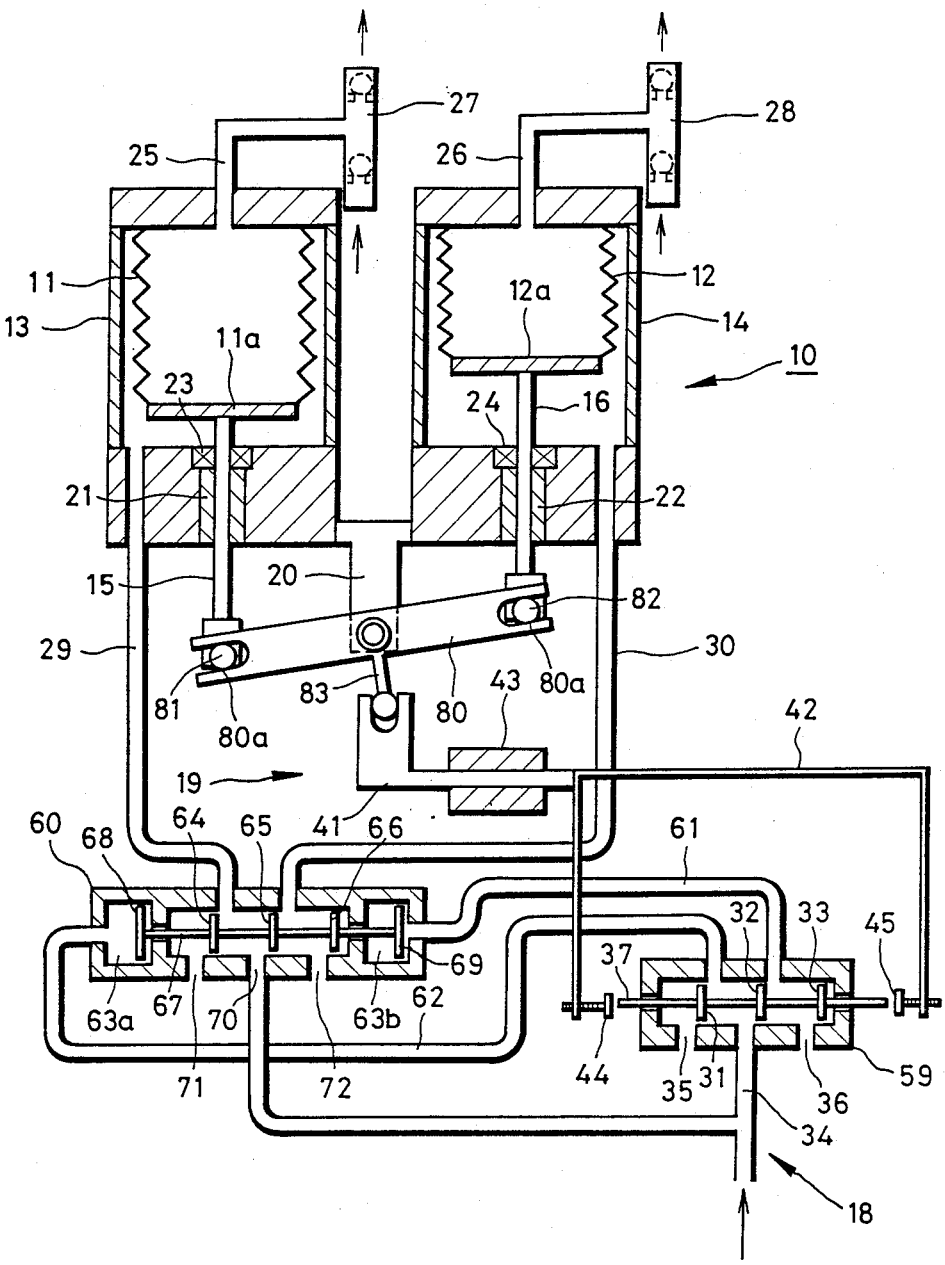
FIG. 2 is a sectional view of the detail of the bellows pump according to a second embodiment of the present invention.
Figure 3:
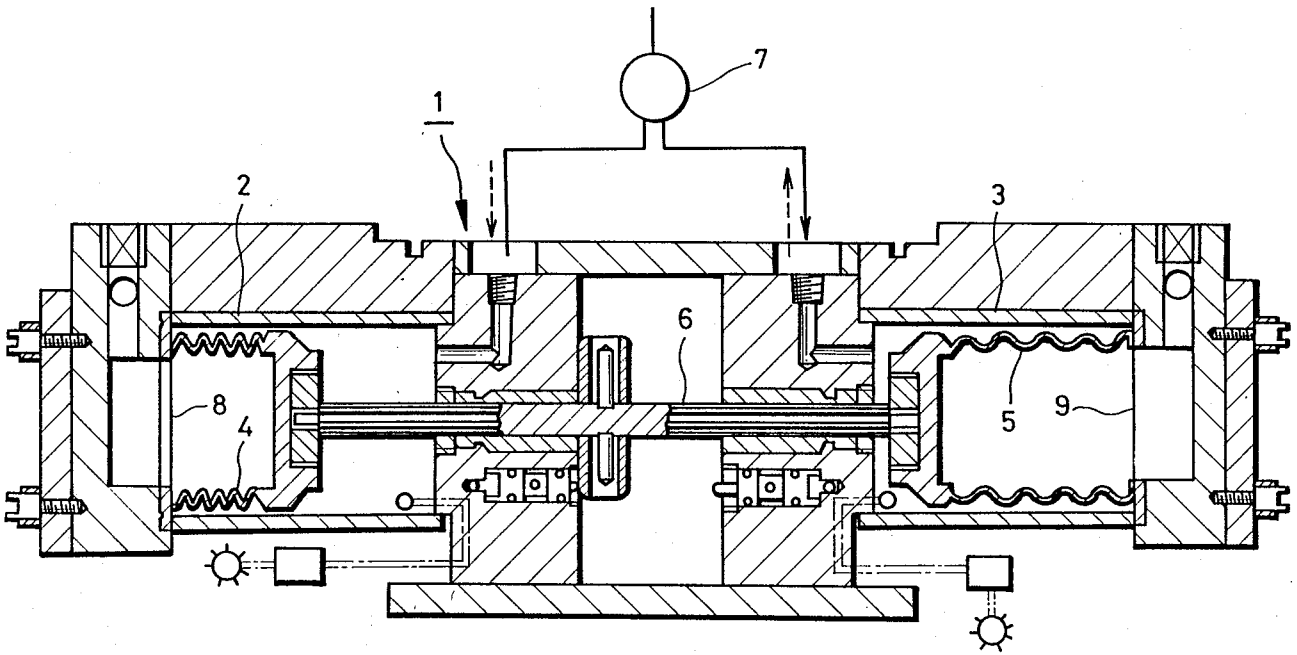
FIG. 3 PRIOR ART
FIG. 3 is a partially sectional view of the prior art bellows pump.

FIG. 2 illustrates a second embodiment of the present invention. A bellows pump 10 of the second embodiment is similar to the bellows pump of the first embodiment, except that the gas pumping means 18 and the actuating means 19 in the first embodiment are replaced by other means.

The actuating means 19 in the second embodiment includes a straight lever 80 fitted at its opposite ends with the lower ends of the rods 15 and 16 and pivoted at its intermediate portion on the lower protruding end of the stay 20.

The straight lever 80 has U-shaped portions 80*a* formed at its opposite ends, and pins 81 and 82 perpendicularly mounted on the lower ends of the rods 15 and 16 are pivotally fitted in the U-shaped portions 80*a*, respectively. In addition, the straight lever 80 has an arm 83 substantially perpendicularly mounted at the pivotal center to depend therefrom, and is connected with the slider 41 through the arm 83.

The gas pumping means 18 includes two directional control valve mechanisms 59 and 60 which are arranged so that the second (main) directional control valve mechanism 60 is operated through the first directional control valve mechanism 59, permitting the compressed gas to be fed from the second directional control valve mechanism 60 alternately into the cylinder cases 13 and 14.

The first directional control valve mechanism 59 is connected to the second directional control valve mechanism 60 by means of pipes 61 and 62.

The second directional control valve mechanism 60 includes chambers 63*a* and 63*b* at the opposite sides of a casing body thereof, and ends of the pipes 61 and 62 are connected to the chambers 63*a* and 63*b*, respectively. Ends of a shaft 67 having valve disks 64, 65 and 66 attached thereon protrude into the chambers 63*a* and 63*b*, respectively, and valve disks 68 and 69 are disposed in the chambers 63*a* and 63*b*, respectively. A pipe 29 communicating with the cylinder case 13 and a pipe 30 communicating with the cylinder case 14 are also connected at their ends to an upper side of the casing body. A gas inlet port 70 is provided in a lower side of the casing body, and gas outlet ports 71 and 72 are provided on the opposite sides of the gas inlet port 70.

Thus, the compressed gas being fed from a compressor (not shown) is diverted into the directional control valve mechanisms 59 and 60 and pumped through the second valve mechanism 60 into the pipe 29 and then into the cylinder case 13, while being pumped through the first valve mechanism 59 into the pipe 62 and then into the gas chamber 63*a*. During this time, the cylinder case 13 is operated (in a discharge mode) to contract the bellows 11 by the action of the compressed gas, and the shaft 67 of the directional control valve mechanism 60 is moved rightwardly by the valve disk 68 urged by the compressed gas (at this time, the gas within the chamber 63*b* is discharged from the gas outlet port 36 through the pipe 61).

At the same time, the cylinder case 14 is operated (in a suction mode) to expand the bellows 12 through the actuating means 19, and the gas within the cylinder case 14 is discharged from the gas outlet port 72 through the pipe 30. This is continued until the internal pressure of the cylinder case 13 is substantially equal to the internal pressure of the chamber 63*a*.

Thereafter, when the individual directional control valve mechanism 59, 60 has the shaft 37, 67 moved by a predetermined distance by the actuating means 19, the direction of movement of the valve disks is changed over. In this condition, the compressed gas fed from the compressor is pumped through the second directional control valve mechanism 60 via pipe 30 into the cylinder case 14, on the one hand, and through the first directional control valve mechanism 59 via the pipe 61 into the chamber 63*b*, on the other hand. During this time, the bellows 12 is contracted, and the shaft 67 of the directional control valve mechanism 60 is moved leftwardly by the valve disk 69 urged by the action of the compressed gas (at this time, the gas within the chamber 63*a* is discharged from the gas outlet port 35 through the pipe 61).

At the same time, the cylinder case 13 is operated so that the bellows 11 is expanded, and the gas within the cylinder case 13 is discharged from the gas outlet port 71 through the pipe 29. Repeating of the above operation allows the liquid to be transferred with suction and discharge forces corresponding to the expansion and contraction of the bellows 11 and 12.

In the bellows pump of this embodiment, the second directional valve mechanism 60 is operated through the first directional valve mechanism 59 to permit the gas to flow into and out of the cylinder cases 13 and 14 and therefore, even if the individual valve disk of the first directional control valve mechanism 59 is stopped at the intermediate location between the gas outlet port 35, 36 and the gas inlet port 34 due to any trouble, this cannot cause the second directional control valve mechanism 60 to be influenced. That is, there is maintained the normal operation such that while the compressed gas enters either one of the cylinder cases 13 or 14, the gas within the other cylinder case is discharged. Accordingly, the bellows pump of the present invention is of a higher quality free from any trouble, in addition to the fixed delivery.

The preferred embodiments of the present invention have been described, but it will be understood that the present invention is not limited to these embodiments and many variations and modifications can be made by those skilled in the art without departing from the spirit and scope of the present invention.

What is claimed is:

1. A bellows pump having two bellows made of a plastic material and provided with liquid inlet and outlet ports for transferring a liquid by expanding and contracting the bellows, comprising:

cylinder cases set in parallal in each of which the bellows is vertically expandably and contractably contained and mounted at its access port side to a ceiling of said cylinder case;

gas pumping means for alternately feeding a compressed gas from lower ends thereof into said cylinder cases;

a pair of rods passed through bottoms of the cylinder cases and fixed to the lower ends of the bellows, and adapted to be moved in response to the expansion and contraction of said bellows, and actuating means for alternating said gas pumping means adapted to be operated in response to the up and down movement of said rods.

2. A bellows pump according to claim 1, wherein said actuating means is constructed so that the lower ends of the rods reciprocate in such a manner that, when the compressed gas is fed into one of said cylinder cases to contract said bellows, the other cylinder case is expanded in an interlocking manner.

3. A bellows pump according to claim 2, wherein said actuating means comprises a drum pivotally mounted, and a belt passed around said drum and connected at its opposite ends to the lower ends of said rods.

4. A bellows pump according to claim 1, wherein said actuating means actuates said gas pumping means in response to the up and down movement of said rods to feed the compressed gas alternately into said cylinder cases.

5. A bellows pump according to claim 2, wherein said actuating means actuates said gas pumping means in response to the up and down movement of said rods to feed the compressed gas alternately into said cylinder cases.

* * * * *